United States Patent [19]

Katzfey

[11] 4,236,393

[45] Dec. 2, 1980

[54] CONTINUOUS TUNNEL BATCH WASHER

[75] Inventor: James M. Katzfey, Kenner, La.

[73] Assignee: Pellerin Milnor Corporation, Kenner, La.

[21] Appl. No.: 59,272

[22] Filed: Jul. 19, 1979

[51] Int. Cl.[3] ..... D06F 21/04; D06F 31/00

[52] U.S. Cl. ..... 68/27; 68/153; 68/210

[58] Field of Search ..... 68/27, 58, 140, 142–148, 68/153, 173, 210

[56] References Cited

U.S. PATENT DOCUMENTS

| | | | |
|---|---|---|---|
| 3,995,458 | 12/1976 | Grunewald et al. | 68/140 |
| 4,020,659 | 5/1977 | Bhavsar | 68/27 |
| 4,109,493 | 8/1978 | Hugenbruch | 68/27 |

*Primary Examiner*—Philip R. Coe

*Attorney, Agent, or Firm*—Clarence A. O'Brien; Harvey B. Jacobson

[57] ABSTRACT

A continuous tunnel batch washer of modular construction with the number of modules varying depending upon installational requirements and each module including a drum rotatably supported and driven to oscillate in a predetermined manner during the washing cycle and to rotate unidirectionally during transfer of the load from one module to a succeeding module with a unique chute or trough arrangement extending between the modules for transferring the wash load from one module to a next successive module. The drum in each module is roller supported and chain driven from a common shaft with a plurality of independent motors driving the shaft by a belt drive with each module including a reduction gear driven from the shaft and having an output driving the sprocket chain for the oscillatable and rotatable drum. A programmed control device provides continuous control of each batch of articles being laundered as they progress to the successive modules in the machine.

9 Claims, 9 Drawing Figures

62
104
70
112
A
48
42
116
44
72
24
32
66
110
64
B
58
54
50
108
34
38
36
106
40

CONTINUOUS TUNNEL BATCH WASHER

BACKGROUND OF THE INVENTION

1. Field of the Invention

The present invention generally relates to a continuous laundry machine in the form of a tunnel batch washer of modular construction in which each module includes a rotatably supported drum with all of the drums being driven from a common shaft in an oscillatory manner during one cycle and then being driven in a unidirectional manner to transfer the batch or load from one module to another with a unique transfer chute being provided to transfer the load from one module to a successive module during unidirectional rotation.

2. Description of Relevant Art

Continuous batch washers are being used extensively with various structures being utilized to transfer batches from one compartment or module of the machine to another. Such devices include oscillatory rotation of the drums and transfer of the load from one drum to another by conveying structures with transfer being effected by unidirectional rotation of the drums in some instances and in other structures, a screw-type transfer device or a modified spiral device is employed. The following list of patents are illustrative of the relevant art in this field:

| | | |
|---|---|---|
| U.S.A. | | |
| 649,152 | 2,300,690 | 3,406,543 |
| 1,464,722 | 2,978,229 | 3,509,744 |
| 2,056,803 | 3,103,802 | 3,550,406 |
| 2,057,815 | 1,603,802 | |
| 2,112,848 | 3,336,768 | |
| BRITISH | | |
| 514,001 | 1,187,859 | 1,501,652 |
| 1,028,709 | 1,501,651 | |
| FRENCH | | |
| 1,383,502 | 1,541,157 | |
| GERMAN | | |
| 867,685 | 1,159,895 | 1,585,890 |
| 872,931 | 1,194,362 | 1,849,718 |
| 882,391 | 1,243,630 | 1,916,615 |
| 885,389 | 1,267,655 | 1,925,512 |
| 894,686 | 1,277,795 | 1,948,045 |
| 923,183 | 1,288,051 | 7,005,241 |
| 926,067 | 1,290,909 | |
| 1,049,817 | 1,460,822 | |

SUMMARY OF THE INVENTION

An object of the present invention is to provide a continuous tunnel batch washer of modular construction with each module including a rotatably supported drum driven in an oscillatory manner during the washing operation and in a unidirectional manner during transfer of the load from one module to a successive module.

Another object of the invention is to provide a washer in accordance with the preceding object utilizing a transfer chute or scoop for effectively and positively transferring the load from one module to a successive module during unidirectional rotation of the drums.

A further object of the invention is to provide a washer in which each module includes a drum having opposed side walls with an opening of less diameter than the periphery of the drum with each drum being chain driven with the sprocket attached to the drum being connected to a flange rigidly affixed to the relatively small diameter portion of the drum.

Still another object of the invention is to provide a washer in accordance with the preceding objects which is timer controlled to provide washing cycles and a rest period during which other controls may vary the washing action in each module with such controls enabling successive batches of articles to be properly washed as they proceed from one module to the other.

A further important object of the present invention is to provide a continuous tunnel batch washer of modular construction which is dependable in operation, easy to maintain, effective in transferring batches of articles from module to module and providing effective washing control for each batch as it proceeds from one module to another.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
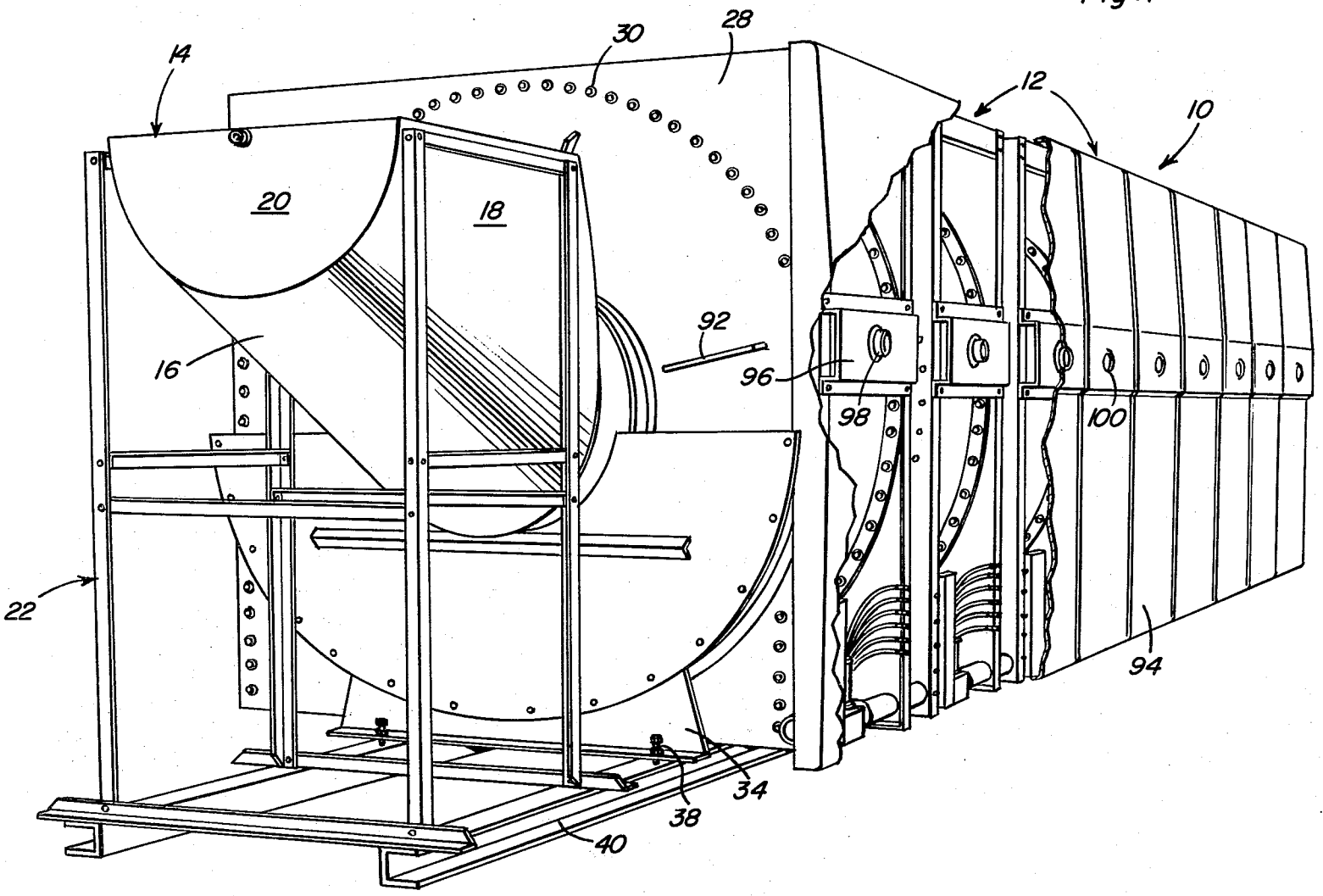
FIG. 1 is a perspective view of the washer from the entrance end with portions of the removable side panels being omitted.

Referring now specifically to the drawings, the continuous tunnel batch washer of the present invention is generally designated by the numeral 10 and, as illustrated, includes a plurality of modules each of which is generally designated by the numeral 12 with the number of modules varying depending upon the installational requirements. Inasmuch as each module 12 is of substantially identical construction, the details of only one module will be described. As illustrated, the inlet end of the washer 10 is provided with a loading chute 14 which includes an inclined bottom wall 16 which is arcuately curved and includes upwardly extending side walls 18 and an end closure 20. The opposite end of the chute 14 communicates with the first module of the washer 10 and the chute 14 may be supported in any suitable manner as by framework 22 with the chute 14 receiving articles to be laundered in any suitable manner.

Each module 12 includes a cylindrical casing 24 having an outwardly turned flange 26 bolted to side walls 28 by bolts 30. The side walls 28 are generally square or rectangular in configuration with the periphery thereof including an inturned flange 32 for rigidity and to provide mounting flanges for other structural arrangements to be described hereinafter. The lower ends of the side walls 28 are provided with support plates 34 at the central portions thereof which terminate in flanges 36 having adjustable support members 38 mounted thereon for supporting the modules from a base 40 which may be preassembled with the modules or the base 40 may be in the form of an existing floor or other support structure at the site of installaton. When the base 40 is in the form of I-beams, skids or the like, the machine may be more easily assembled either at the manufacturing site or at the installation site.

Figure 4:
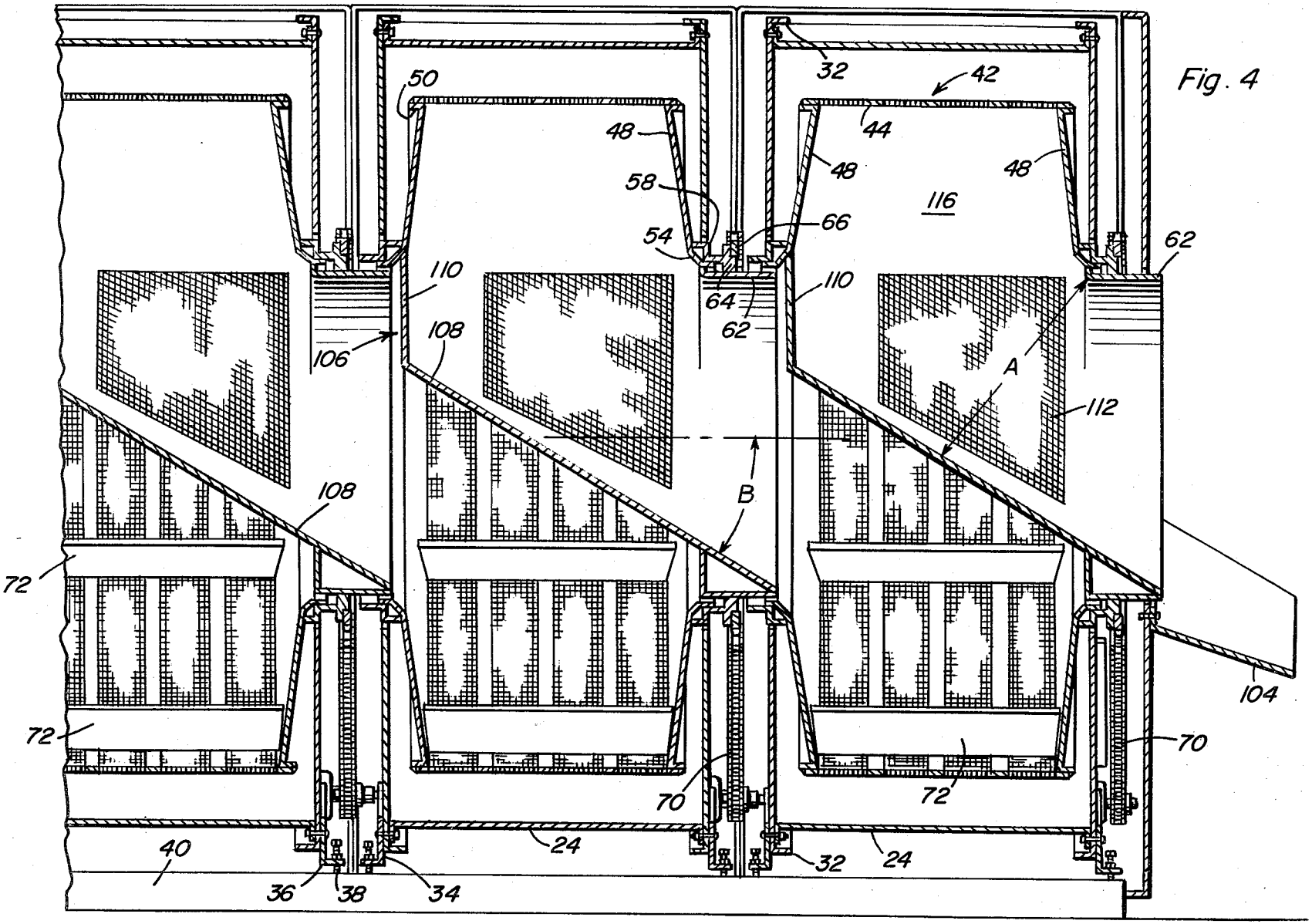
FIG. 4 is a longitudinal sectional view taken substantially upon a plane passing along section line 4—4 of FIG. 2 illustrating the structural details of adjacent modules.
Figure 6:
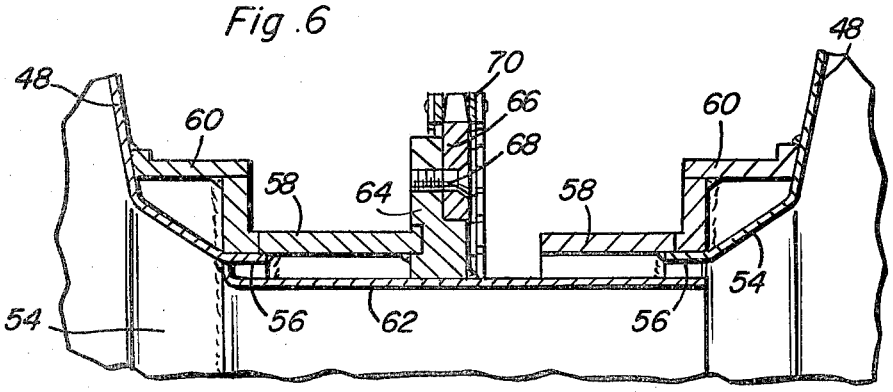
FIG. 6 is a detailed sectional view illustrating the drive sprocket and associated structural relationship between adjacent drums of adjacent modules.
Figure 7:
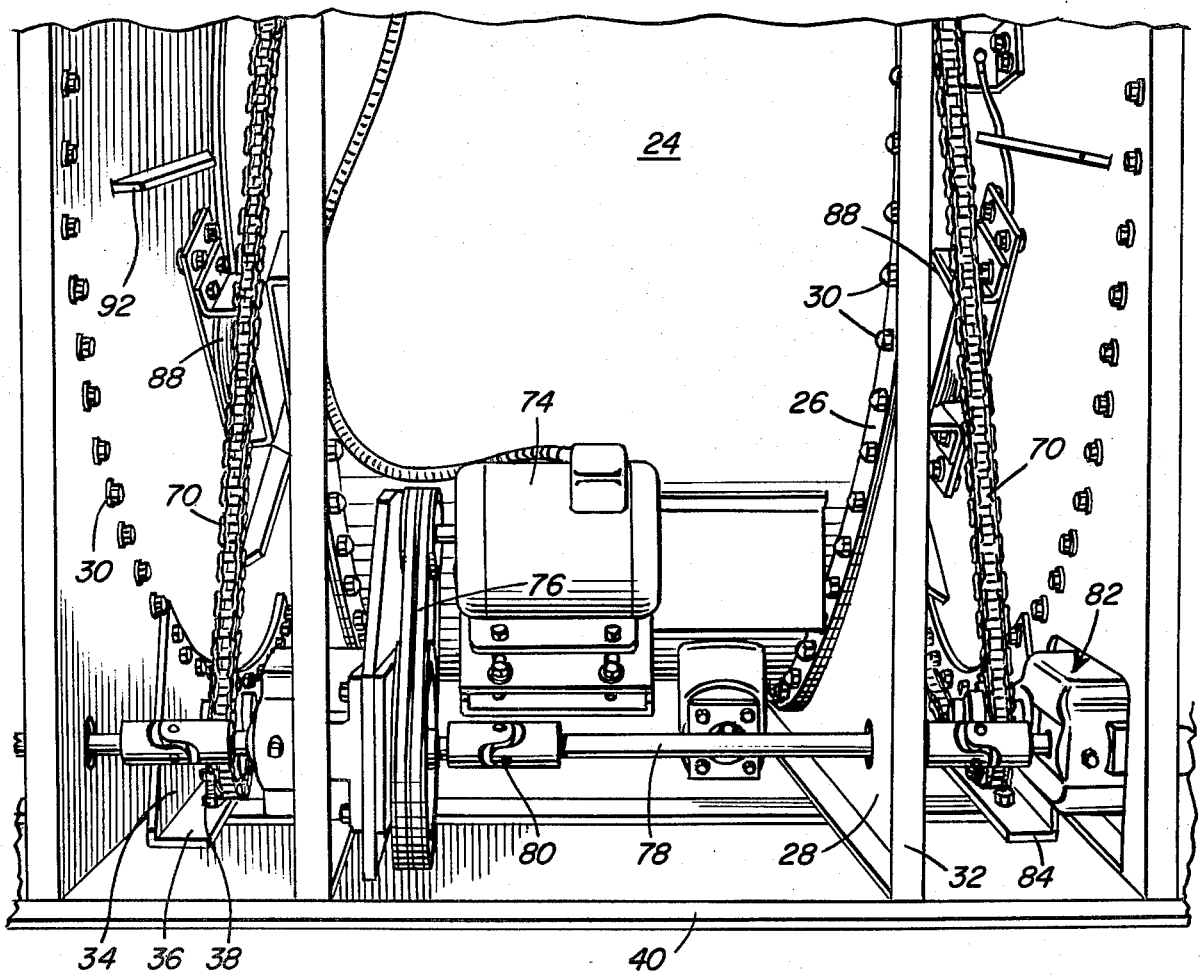
FIG. 7 is a detailed fragmental elevational view illustrating the drive structure for the drums.
Figure 8:
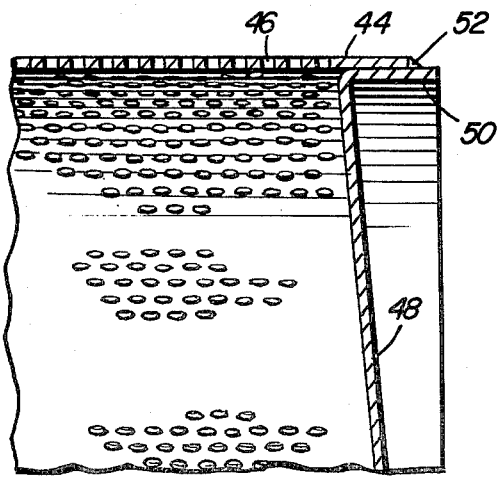
FIG. 8 is a fragmental sectional view of a portion of the periphery of a drum.
Figure 9:
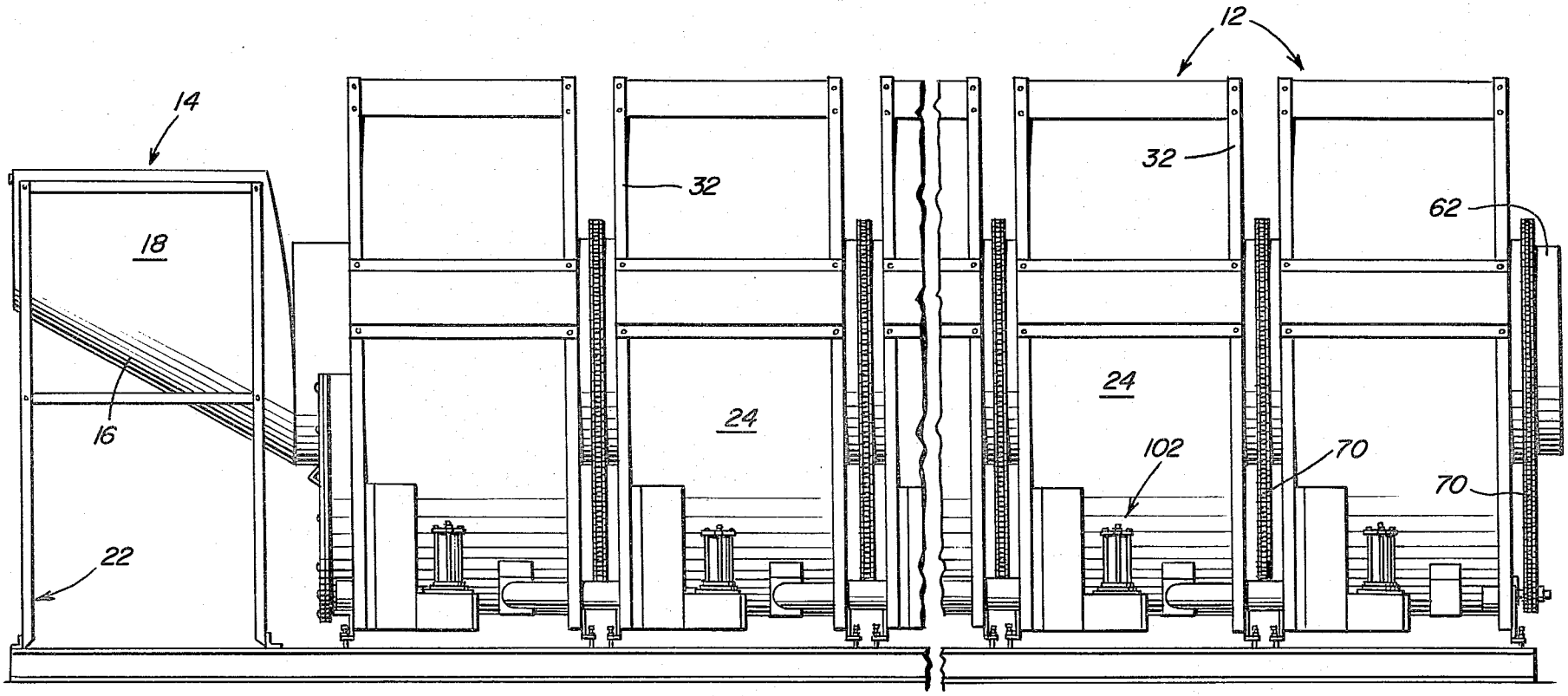
FIG. 9 is a partial side elevational view of the washer illustrating the liquid control and discharge structure for the modules.

Mounted internally of each cylindrical casing 24 is a drum generally designated by numeral 42 and including a cylindrical peripheral wall 44 having peripheral perforated areas 46 therein to enable circulation of water or the washing solution through the periphery of the drum in a well known manner. The peripheral wall 44 is rigidly joined to end walls 48 which have a outturned flange 50 at the periphery secured at the peripheral wall 44 as by welding 52 or the like. The end walls 48 on each drum 42 diverge radially inwardly as illustrated in FIG. 4 with each end wall 48 terminating in a longitudinally outwardly inclined transition portion 54 and a short longitudinal flange portion 56 rigidly affixed to a cylindrical flange 58 and reinforcing members 60 as illustrated in FIG. 6. One end wall in each module has an elongated cylindrical flange 62 rigidly affixed to the flange 56 and which is of slightly smaller external diameter than the flange 56 so that the longer flange 62 telescopes into the flange 56 of an adjacent drum with a suitable and conventional seal being provided between the telescoping portions of the flange 62 and flange 56. The flange 58 on the discharge end of each drum 42 is provided with a peripheral flange 64 having a sprocket gear flange 66 attached thereto by suitable fasteners 68 or the like with a sprocket drive chain 70 entrained over the gear 66 with the diameter of the gear 66 being only slightly greater than the cylindrical flange 62 which defines the passageway from the drum 42 in one module 12 to a successive module. This arrangement enables a shorter chain length and less diameter for the gear 66. Also, the interior of the drum 42 is provided with a plurality of circumferentially spaced, generally V-shaped ribs 72 rigidly affixed to the end walls 48 and peripheral wall 44 to insure that the articles to be laundered and the water in the drum will be elevated and tumbled during oscillation of the drums 42.

Each of the drums 42 is driven by a reversible motor 74 having a double V-belt drive output 76 to elongated jack shaft 78 oriented at the lower outer corner of the modules 12 with the segments of the shaft 78 being interconnected by connectors 80 which may have resilient inserts to enable some limited degree of flexing of the shaft 78. Each module includes a reduction gear drive unit 82 supported by a suitable bracket structure 84 with the shaft 78 extending through and forming an input to the reduction gear 82. The output of the reduction gear 82 includes a sprocket gear 86 that is drivingly engaged with the sprocket chain 70 thus effectively driving the drum 42 at the discharge end thereof, that is, the end at which the load is transferred from one drum to an adjacent successive drum. Thus, while each module 12 includes an independent motor 74, all of the motors are interconnected by the jack shaft or lay shaft 78 so that in the event of failure of one of the motors, the washing machine will remain operatively until repairs or replacement of the motor can be made.

Figure 2:
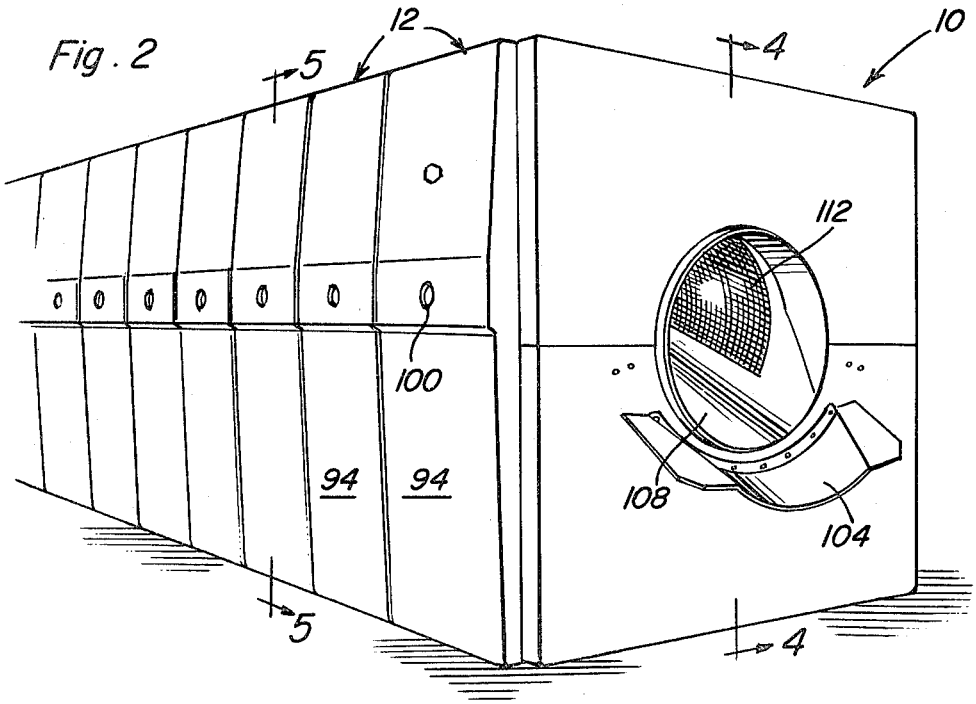
FIG. 2 is a perspective view of the washer from the discharge end.
Figure 3:
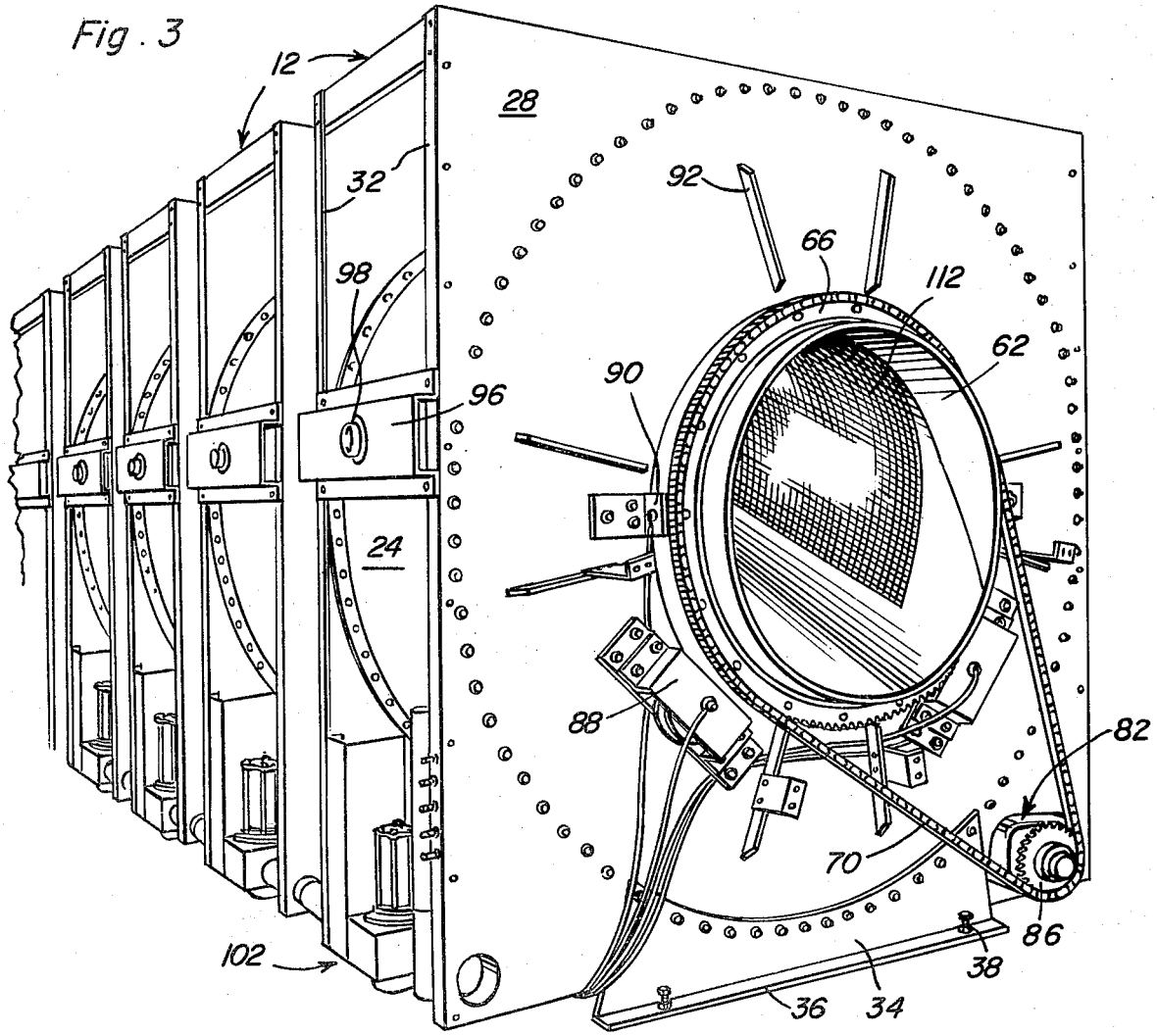
FIG. 3 is a perspective view of the washer illustrating certain of the structural details thereof.

As illustrated, the flanges 58 on each drum are supported by rollers 88 engaging the periphery of the flanges 58 on opposite sides of the bottom center of the flanges 58 and to provide lateral stability, the flange 64 is engaged by rollers 90 which have a rotational axis perpendicular to the axis of rotation of the drum 42 whereas the rollers 88 have axes of rotation parallel to the axis of rotation of the drum 42. As illustrated in FIG. 3, the side walls 28 of the casing 24 may be provided with reinforcing flanges 92 disposed radially to reinforce the side walls 28 since they support the rotational weight of the drums and their contents. The exterior vertical flanges on the side walls 28 provide mounting structures for removable side panels 94 which conceal the drive mechanism and cover centrally located panels 96 which include electrical junction boxes and the like and also indicators or controls 98 which are observable through apertures 100 formed in the panels 94 which enables inspection of the indicator gauges or controls 98 without removing the panels 94 but the panels 94 are readily removable to provide access to the drive mechanism, shaft and the like located along one side of the washing machine and also enable access to the water level control and discharge assemblies 102 located along the other side of the machine. FIG. 2 illustrates the discharge end of the machine with a stationary chute 104 underlying the discharge end of the discharge drum by which the load discharged from the last module 12 will be discharged into a water extraction device, onto a conveyor or the like so that the articles being laundered may be further treated as desired.

Figure 5:
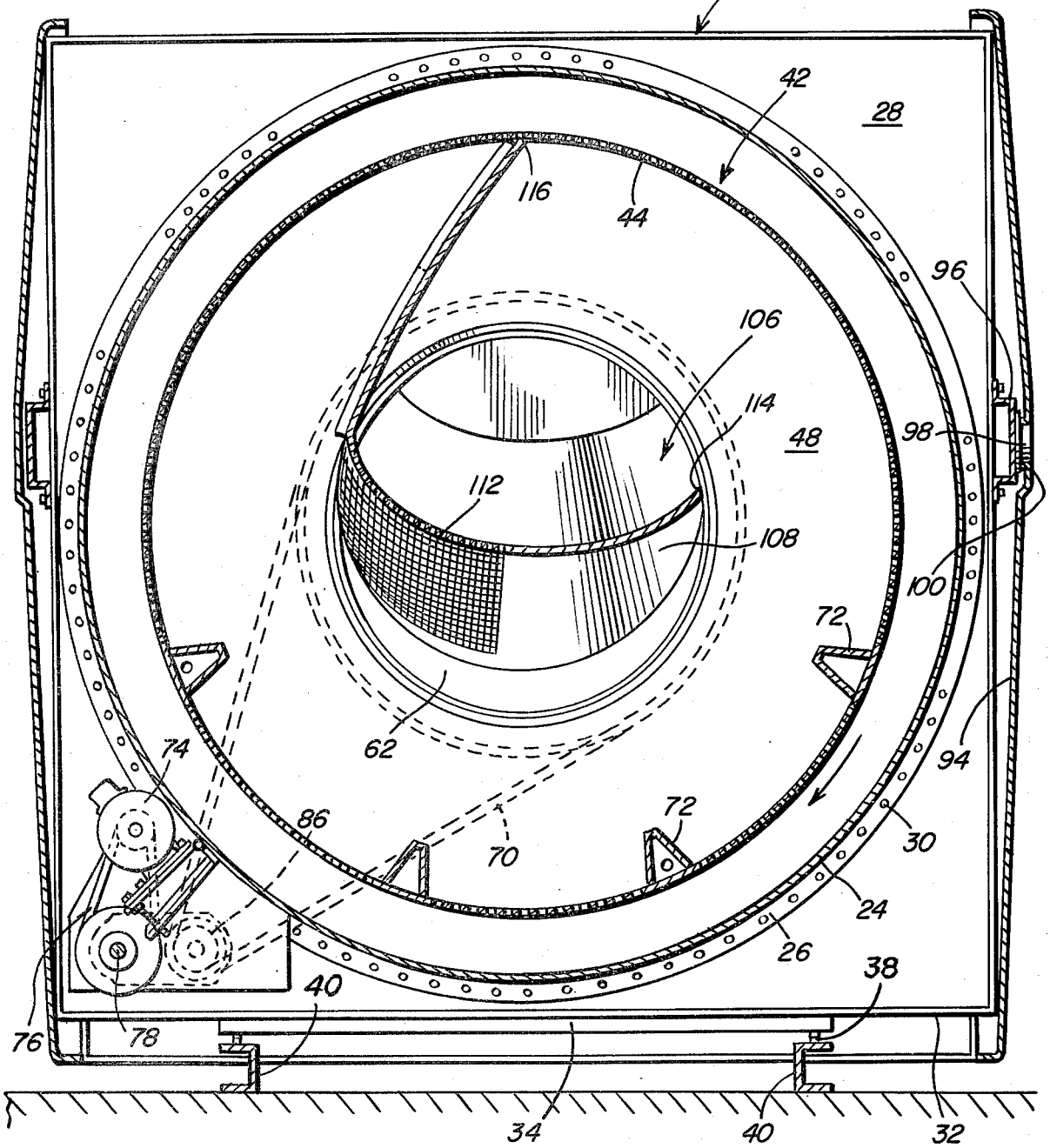
FIG. 5 is a transverse, sectional view taken substantially upon a plane passing along section line 5—5 of FIG. 2 illustrating further structural details of one module of the washer.

As set forth, one of the significant features is the chute provided to transfer the load from one module to another with this transfer chute generally being designated by numeral 106 and illustrated in FIGS. 4 and 5. As illustrated, the transfer chute or scoop 106 includes an inclined bottom wall 108 which has a terminal edge generally coinciding with and joined with the free end edge of the flange 62 of the drum in which the chute 106 is mounted. The wall 108 extends upwardly and terminates immediately inwardly of the free edge of the flange 62 on the drum in the immediately preceding module. A vertical wall portion 110 interconnects the end of the bottom wall 108 in the entrance opening to the drum 42 in which it is mounted and the inclined transition portion 54 of the end wall 48 as illustrated in FIG. 4. This orientation of the bottom wall 108 provides the largest possible throat area for discharge of the load from one drum to the other with this large discharge area or throat being designated by the letter A in FIG. 4. Peripherally, the wall 108 extends from one edge to the other in a spiral manner and includes a perforated section 112 remote from one edge 114 which generally terminates at its lower end at the periphery of the flange 62. The perforated edge of the wall 108 terminates in an edge 116 extending to a point closer to the peripheral wall 44 of the drum 42. During the washing operation, the drive motor which is automatically reversed will rotate the drum in one direction for a predetermined distance less than one revolution and then rotate the drum in an opposite direction for the same degree of movement. For example, the reversing of the drum may be varied so that it will oscillate anywhere from approximately 270° to 320° in opposite directions. During this oscillation, the articles and washing solution will be lifted and tumbled by the ribs 72 but will not fall into the concave portion of the chute 106. On observing FIG. 5, during oscillation, the articles will tumble back toward the bottom of the drum when oscillated as the articles are elevated to a point somewhere near the horizontal center of the drum during its oscillation. Location of the ribs 72 below the edge 114 assures that the articles being laundered will not be lifted above this edge since the relationship between the edge 114 and the ribs and drum remain constant and any articles rotated with the drum in a counterclockwise direction as illustrated in FIG. 5 will tumble downwardly between the interior of the drum and the edge 114 or tumble onto the convex surface of the wall 108. During clockwise oscillation, the edge 116 will not move in a clockwise direction sufficient to lift and discharge the articles being washed onto the concave upper surface of the wall 108. However, when the washing cycle has been completed and the motors driven in a manner to rotate the drums in a unidirectional motion as indicated by the arrow in FIG. 5, then the extended edge portion 116 of the chute 106 will pick up the load and completely discharge it onto the upper surface of the chute wall 108 which due to its inclined construction will cause the load to be discharged from the edge of the flange 62 into the next adjacent drum or be discharged from the machine at the endmost module.

In the control of the machine, the angular movement during oscillation may be varied and a timer control arrangement provided for determining the wash cycle and a rest period after each wash cycle during which a programmed control device advances the programmed control for each load to the next module thereby enabling various types of articles to be washed in successive batches with the programmed controls for each batch proceeding from one module to the other as the batch of articles being laundered proceeds from one module to the other. This type of control is disclosed in more detail in the copending application of Norvin L. Pellerin, Ser. No. 903,115, filed May 5, 1978, and assigned to the same assignee with the subject matter of that application being incorporated herein by reference thereto.

As set forth, modified spiral devices and screw devices for transferring the load from one module to the other include an angle of transfer relative to the axis of rotation which is quite steep which has resulted in a restricted throat opening with the throat being defined as that area through which the load must pass when being discharged from one drum into another. This steep angle of the transfer member which resulted in a restricted throat area also frequently results in blockage of the throat, that is, the articles forming the load in the washer drum hangs up on the edges of the discharge opening thus blocking the drum and resulting in incomplete transfer of the load. In this invention, the angle of transfer, that is, the included angle between the axis of rotation and the chute wall 108 has been decreased thus opening up the throat by providing a larger throat as indicated by the dimension A in FIG. 4. It has been found that maximum effectiveness of the transfer operation is accomplished when the included angle between the wall 108 and the axis of rotation of the drum ranges between 30° and 45° with the optimum angular relation being 34°, as indicated by angle B in FIG. 4. This decrease in the angle of transfer is accomplished by utilizing the end wall 110 which does not interfer with transfer of the load and extending the wall 108 to the end edge of the flange 62.

The utility of the control disclosed in the copending application enables the operator to program each batch or load so that the appropriate wash conditions will be provided in each module for the particular batch in that module. For example, if red tablecloths are being washed, each module must recognize that red tablecloths are being positioned therein and the appropriate conditions must be supplied in that module to properly wash or otherwise treat the red tablecloths therein. This information is transferred from module to module as each batch progresses through the machine. If white sheets are placed in the machine after the red tablecloths, the programmed control actuated by the operator will appropriately indicate that the soiled water with red dye therein must be drained from each module before the white sheets enter that module to prevent the white sheets from being partially dyed. Customarily, several "empty" batches are run through a machine to prevent this from occurring thus reducing the productivity of the machine. With this type of control, the soiled or dyed water may be removed from each module after the red tablesclothes have completed their cycle in that module so that as the batch is discharged from the module, the soiled water is also removed therefrom and appropriate wash conditions will be imparted to the white sheets when they enter that module.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A longitudinally extending continuous tunnel batch washer comprising a plurality of longitudinally aligned modules with inlet means at one end of the washer for feeding articles to be laundered into the washer and discharge means at the opposite end of the washer, each module including a stationary casing and a rotatably supported drum within the casing with the drum being supported for oscillatory and rotary movement about a horizontal axis, each drum including spaced end walls, each end wall of each drum including a large opening, means forming a connection between the openings to provide communication between adjacent modules, and each drum including a transfer chute mounted therein retaining articles to be laundered during oscillation and transferring the article from one drum to an adjacent successive drum during unidirectional rotation, said chute including an inclined wall having a discharge end connected to a portion of the periphery of the opening in one end wall of the drum and an end wall connecting the opposite end of the inclined wall to the opening in the opposite end wall of the drum with the end wall of the chute occupying a small portion of the opening in the end wall of the drum to reduce interference with incoming articles, said inclined wall of the chute being spirally configured circumferentially of the drum with at least one side edge of the inclined wall being spaced from the periphery of the drum.

2. The washer as defined in claim 1 wherein said inclined wall of the chute is spaced from the opposite periphery of the opening in the end wall of the drum a distance greater than if the inclined wall extended straight diagonally between opposite extreme portions of the periphery of the openings with the chute end wall enabling a decrease in the included angle between the axis of rotation of the drum and the inclined wall.

3. The washer as defined in claim 2 wherein the end wall of the drum having the inclined wall connected thereto includes a longitudinally extending circumferential flange coinciding with the periphery of the opening and telescopically received in the opening of a successive drum to form said connection between drums and to provide transfer of the articles, said inclined wall extending to and being connected with the free end of the flange thereby further enabling decrease of the included angle between the inclined wall and axis of rotation.

4. The washer as defined in claim 3 wherein said inclined wall includes a perforated portion spaced from said one side edge of the inclined wall to enable liquid to drain therethrough during movement of the drum.

5. The washer as defined in claim 3 wherein said drum includes a sprocket gear mounted thereon in close encircling relation to the flange to enable a sprocket gear to be used having a peripheral dimension substantially less than the peripheral dimension of the drum.

6. The washer as defined in claim 5 wherein a single drive shaft extends alongside the modules in parallel relation to the axis of rotation of the drums, a plurality of independent motors driving said shaft, a sprocket chain engaged with each sprocket gear, and reduction gear means interconnecting the shaft and each sprocket chain for driving the drums in an oscillatory or rotatable manner.

7. The washer as defined in claim 6 wherein the longitudinally extending flange to which the inclined wall is connected includes a radially extending circumferential flange, said sprocket gear being secured to the radially extending flange and roller means engaging the flange to support the drum for oscillation and rotation about a horizontal axis and to laterally stabilize the drums to preclude longitudinal movement of the drums.

8. The washer as defined in claim 2 wherein the included angle between the axis of rotation and the inclined wall ranges between 30° and 45°.

9. The washer as defined in claim 8 wherein said angle is approximately 34°.

* * * * *